US011105114B2

(12) United States Patent
Presti

(10) Patent No.: US 11,105,114 B2
(45) Date of Patent: Aug. 31, 2021

(54) MODULAR PRIVACY FENCE WITH INDIVIDUALLY REPLACEABLE PICKETS

(71) Applicant: Kelly Presti, Fairview, TX (US)

(72) Inventor: Kelly Presti, Fairview, TX (US)

( * ) Notice: Subject to any disclaimer, the term of this patent is extended or adjusted under 35 U.S.C. 154(b) by 16 days.

(21) Appl. No.: 16/507,127

(22) Filed: Jul. 10, 2019

(65) Prior Publication Data

US 2019/0330878 A1 Oct. 31, 2019

Related U.S. Application Data

(63) Continuation-in-part of application No. 15/434,792, filed on Feb. 16, 2017, now Pat. No. 10,738,503, which is a continuation of application No. 14/627,685, filed on Feb. 20, 2015, now Pat. No. 9,574,370.

(51) Int. Cl.
*E04H 17/14* (2006.01)

(52) U.S. Cl.
CPC ..... *E04H 17/1447* (2021.01); *E04H 17/1417* (2013.01); *E04H 17/1439* (2013.01); *E04H 17/1473* (2021.01); *E04H 17/1478* (2021.01)

(58) Field of Classification Search
CPC ..... E04H 17/1417; E04H 17/1421; E04H 17/1426; E04H 17/143; E04H 2017/1447; E04H 2017/1473; E04H 17/1434; E04F 11/1834
See application file for complete search history.

(56) References Cited

U.S. PATENT DOCUMENTS

| | | | | |
|---|---|---|---|---|
| 282,180 | A | 7/1883 | Erb | |
| 792,393 | A | 6/1905 | Brust | |
| 1,719,360 | A | 7/1929 | Deike | |
| 2,484,413 | A * | 10/1949 | Kouril, Jr. | E04H 17/1434 256/26 |
| 2,588,147 | A | 2/1950 | Morris | |
| 2,607,563 | A * | 8/1952 | Rochester | E04H 17/1417 256/22 |
| 2,746,723 | A * | 5/1956 | Freeman | E04H 17/1434 256/22 |
| 2,760,759 | A | 8/1956 | Rice | |
| 2,764,438 | A | 9/1956 | Haviland | |
| 2,766,967 | A * | 10/1956 | Roberts | E04H 17/003 256/22 |

(Continued)

FOREIGN PATENT DOCUMENTS

GB 1147178 A 4/1969

*Primary Examiner* — Jonathan P Masinick
(74) *Attorney, Agent, or Firm* — Vincent J. Allen; J. Miguel Hernandez; Carstens & Cahoon, LLP

(57) ABSTRACT

A modular privacy fence, which includes an upper rail, comprises a plurality of fence picket dividers on opposed outer side surfaces of the upper rail. The modular privacy fence also includes a fastener attached to the end of the upper rail, wherein the fastener is arranged to secure the upper rail to a fence post, and a bottom rail with a trough configured to receive a bottom portion of fence pickets. In some embodiments, the upper rail is configured to receive fence pickets between adjacent dividers. In such arrangements, the first plurality of fence picket dividers on a first side of the upper rail is offset from the second plurality of fence picket dividers on the opposing side of the upper rail in a direction parallel to the upper rail.

20 Claims, 15 Drawing Sheets

(56) References Cited

U.S. PATENT DOCUMENTS

| | | | | |
|---|---|---|---|---|
| 2,919,032 | A | 12/1959 | Sinawski | |
| 2,958,422 | A | 11/1960 | Caloiero et al. | |
| 3,095,184 | A | 6/1963 | Boxberger | |
| 3,218,036 | A | 11/1965 | Kozub | |
| 3,303,622 | A | 2/1967 | Minds, Jr. | |
| 3,960,367 | A | 6/1976 | Rogers | |
| 4,062,522 | A | 12/1977 | Lepetri | |
| 4,272,060 | A | 6/1981 | Stafford | |
| 4,526,348 | A | 7/1985 | Cammack | |
| 4,923,176 | A * | 5/1990 | Heinz | E04H 17/1421 256/65.06 |
| 4,951,925 | A * | 8/1990 | Schultz | F16B 7/048 256/65.06 |
| 4,962,914 | A | 10/1990 | Taylor | |
| 4,982,933 | A * | 1/1991 | Schultz | E04H 17/1421 256/22 |
| 5,465,941 | A | 11/1995 | Abbott | |
| 5,601,279 | A | 2/1997 | Schwartz et al. | |
| 5,645,271 | A * | 7/1997 | Nunez | E04H 17/1421 256/24 |
| 5,810,177 | A | 9/1998 | Cabiran | |
| 6,173,944 | B1 | 1/2001 | McCarthy | |
| 6,715,736 | B2 | 4/2004 | Cummings | |
| 6,883,786 | B2 | 4/2005 | Bebendorf | |
| 7,134,646 | B1 | 11/2006 | Brooks et al. | |
| 8,317,164 | B2 | 11/2012 | Ash | |
| 8,366,078 | B2 | 2/2013 | Meglino | |
| 8,631,551 | B1 * | 1/2014 | Payne | E04H 17/1421 29/428 |
| 2002/0125469 | A1 | 9/2002 | Jones | |
| 2004/0012007 | A1 | 1/2004 | Cummings | |
| 2004/0079933 | A1 | 4/2004 | Chesnutt | |
| 2005/0194581 | A1 | 9/2005 | Chesnutt | |
| 2011/0017966 | A1 | 1/2011 | Meglino | |
| 2011/0233496 | A1 | 9/2011 | Caruso | |
| 2011/0248231 | A1 | 10/2011 | Milner et al. | |
| 2012/0145983 | A1 | 6/2012 | Rosicki | |
| 2012/0319067 | A1 | 12/2012 | Millar et al. | |
| 2015/0041743 | A1 | 2/2015 | Richison et al. | |

* cited by examiner

MODULAR PRIVACY FENCE WITH INDIVIDUALLY REPLACEABLE PICKETS

CROSS-REFERENCE TO RELATED APPLICATIONS

This application is a continuation-in-part of U.S. Nonprovisional application Ser. No. 15/434,792, filed Feb. 16, 2017, which is itself a continuation of U.S. Nonprovisional application Ser. No. 14/627,685, filed Feb. 20, 2015, now U.S. Pat. No. 9,574,370 issued Feb. 21, 2017, which are all incorporated by reference in their entirety as examples.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, TABLE, OR COMPUTER PROGRAM LISTING APPENDIX

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

This invention relates in general to hand-constructed barriers, and more particularly to a modular privacy fence with individually replaceable pickets.

2. Description of Related Art

A conventional privacy fence is made of a single row of closely arranged wood pickets that must be specially assembled to match the particular contour and geography of the fenced-in area. Gaps often appear between individual pickets, which can limit the privacy afforded by such a fence. Another disadvantage of such a fence is that the wood pickets deteriorate under continuous exposure to sun, wind, and rain conditions, and often wear unevenly. Such wear can increase the visible gaps between the pickets. When individual fence pickets must be replaced, basic carpentry skills and tools are often required to repair the fence. For example, wood fence pickets are commonly secured in place with staples or nails that must be first removed before installing the new picket. Some fence designs even feature a top rail, which must be removed in order to replace individual pickets.

For increased privacy over single-row picket fences, conventional double-row picket fences are assembled using one or more transverse center rails to which two rows of alternating pickets are nailed or stapled to each side of the center rails. One disadvantage of such a design (beyond the need for basic carpentry skills to assemble one), is that substantial gaps are visible when the fence is viewed at an angle, which reduces the privacy of the fence. Other double-picket or staggered fence designs attempt to improve upon the design by replacing the center rails with a top cap rail, which reduces gaps, but requires special assembly on site.

Metal fences, while more resistant to the abovementioned wear, do not offer the same privacy, security, or aesthetic appeal. Moreover, entirely metal fences are much more costly than wood fences and absorb large amounts of heat during daylight hours, which can make them unsuitable for residential purposes.

SUMMARY

In accordance with one embodiment of the present invention, a modular privacy fence with individually replaceable pickets is provided which substantially eliminates or reduces disadvantages associated with previous systems.

In accordance with another embodiment, a modular privacy fence with individually replaceable pickets is provided, which includes a stringer having two rails, the first rail comprising a plurality of fence picket dividers that protrude in a perpendicular direction from the first rail. The modular privacy fence also includes a fastener attached to the end of the stringer, wherein the fastener is arranged to secure the stringer to a fence post, and a bottom rail with a trough. In particular embodiments, the second rail may also include a separate plurality of fence picket dividers that protrude from the second rail in a direction perpendicular to the second rail and parallel to the first plurality of fence picket dividers. In such arrangements, the first plurality of fence picket dividers is offset from the second plurality of fence picket dividers in a direction parallel to the first rail. In other embodiments, the modular privacy fence may include a compressive fastener that connects the first rail with the second rail, which, when closed, decreases the distance between the first rail and the second rail such that a securing picket divider of the first plurality of fence picket dividers overlaps opposing adjacent picket dividers of the second plurality of fence picket dividers.

In accordance with another embodiment, the second rail of the modular privacy fence instead includes a plurality of gates attached to the ends of some of the fence picket dividers. Each gate may comprise a clasp and a hinge, or each gate may be rotatable about an axis extending from a common picket divider.

In accordance with some embodiments, a modular privacy fence with individually replaceable pickets is provided, which includes a stringer having a single longitudinally extending rail. The rail can include laterally extending fence picket dividers on both outer side surfaces of the rail such that the rail can receive fence pickets in slots between the picket dividers on each side of the rail. For example, the rail is disposed between two rows of fence pickets instead of on the outside of the pickets. One aspect of some embodiments, the rail can be secured to fence posts on each end of the rail using fasteners.

One advantage of a modular privacy fence with individually replaceable pickets is the simple manner in which the fence may be assembled without any special tools or carpentry skills on the part of the installer. The modular privacy fence may be arranged to work with commercially available fence pickets that can be purchased from a local hardware store. If an individual picket needs to be replaced, it may be easily removed and another new picket installed in its place without requiring portions of the fence to be disassembled.

Another advantage is the customizable nature of the stringers, which may feature ornamental designs that add to the aesthetic appeal and, therefore, commercial value of the fence.

BRIEF DESCRIPTION OF THE SEVERAL VIEWS OF THE DRAWINGS

For a more complete understanding of the present invention and its advantages, reference is now made to the following description and the accompanying drawings, in which.

DETAILED DESCRIPTION OF THE INVENTION

Figure 1:
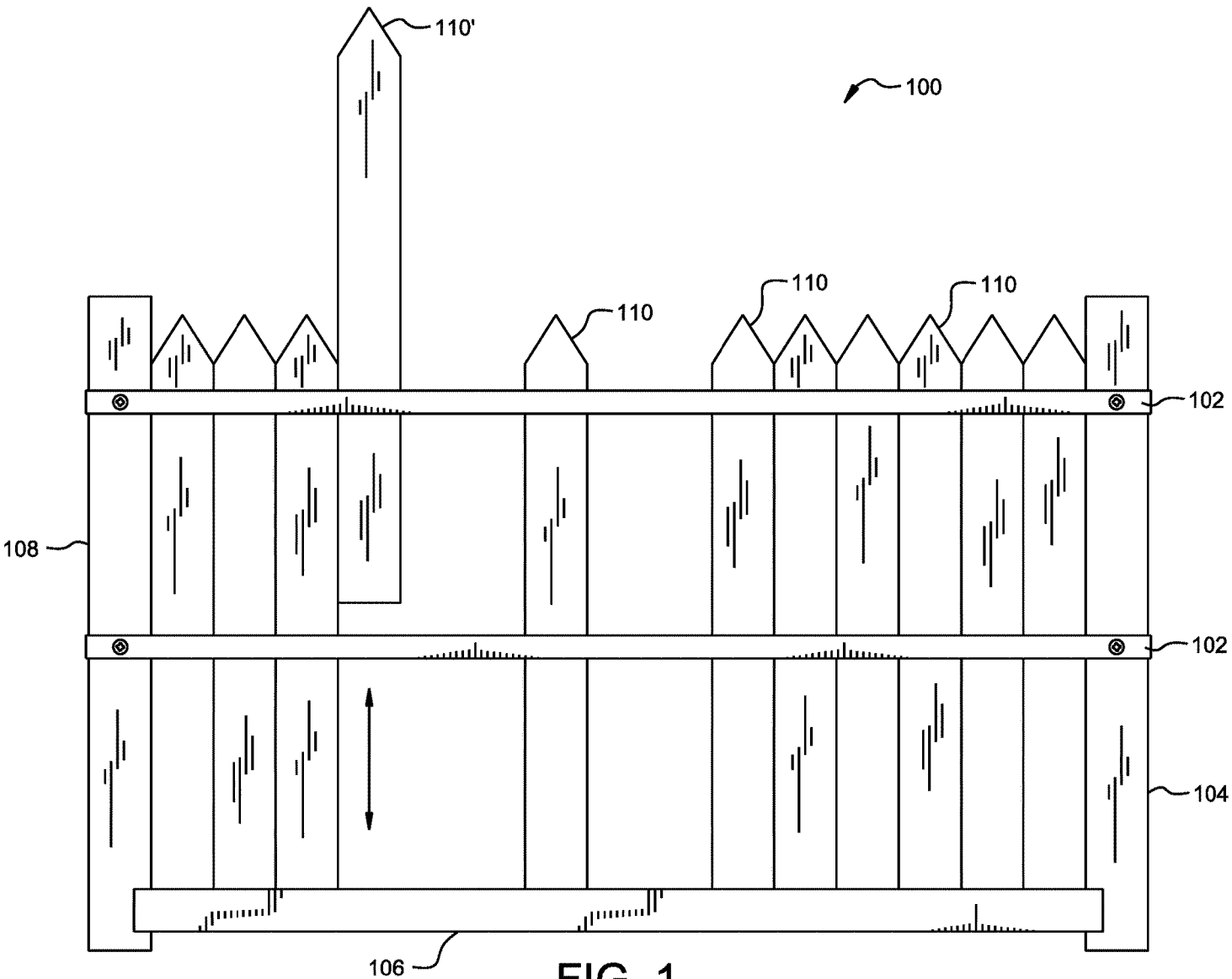
FIG. 1 shows a side view of a modular privacy fence with a single row of fence pickets.

Referring to the drawings, embodiments of the present invention will be described below.

FIG. 1 shows a side view of a modular privacy fence 100 with a single row of fence pickets according to one embodiment. The modular privacy fence 100 is comprised of one or more stringers 102, a bottom rail 106, a pair of fence posts 108, and fence pickets 110. The fence posts 108 may be made of wood, metal, concrete, composite, or any suitably rigid material. Each post 108 may have various shapes in cross-section (e.g., square, circle, etc.). The fence posts 108 will generally be anchored in place by a concrete foundation.

The fence pickets 110 may likewise be made of wood, metal, concrete, composite, or any suitable material. However, the fence pickets 110 are preferably made of wood or composite for aesthetic reasons. The fence pickets 110 may vary in dimension and shape, but will generally have a length corresponding to the desired height of the fence. In preferred embodiments, the modular privacy fence will be configured to work with commercially available wooden pickets, some common dimensions of which are provided in Table 1 below.

TABLE 1

| Length | Width | Depth |
|---|---|---|
| 6' | 3½" | ⅝" |
| 6' | 5½" | ⅝" |
| 6' | 6" | ⅝" |
| 6' | 6" | 1" |
| 8' | 4" | ⅝" |
| 8' | 5½" | ⅝" |
| 8' | 6" | ⅝" |

Of course, fence pickets 110 may also come in other sizes and shapes. For example, a picket 110 to be used with non-privacy alternative embodiment may be much shorter and narrower.

The stringers 102 are used to limit a fence picket's 110 lateral movement. The number of stringers 102 corresponds in general to the height of the fence 100. Taller fences may require more stringers 102 in order to ensure sufficient lateral stability. For example, an eight-foot fence will preferably have at least two stringers. However, the number of stringers 102 may also be increased or decreased for aesthetic or structural reasons. A stringer 102 can be attached to a fence post 108 by any type of suitable connector, including but not limited to: a circumferential bracket and bolt, a transverse bolt that secures a fence post 108 between each side of the stringer 102, slot and tab means, tongue and groove means, welding, etc.

The bottom rail 106 prevents a fence picket 110 from falling through the fence 100. In most embodiments, the bottom rail 106 also provides a level platform that ensures that the fence pickets 110 will have a substantially uniform appearance when installed next to each other. Like a stringer, the bottom rail 106 can be attached to a fence post 108 by any type of suitable connector, including but not limited to: a circumferential bracket and bolt, a transverse bolt that secures a fence post 108 between each side of the stringer 102, slot and tab means, tongue and groove means, welding, etc.

Fence pickets 110 may be installed in the modular privacy fence 100 by sliding a loose fence picket 110' through the stringers 102 until it comes to rest on the bottom rail 106. Unlike many conventional fences with wooden pickets, no additional tools or attachment mechanisms (e.g., staples, nails, glue, or a cap rail) are needed to secure the picket in place according to this particular embodiment. A fence picket 110 may also be slidably removed from the fence 100.

Figure 2A:
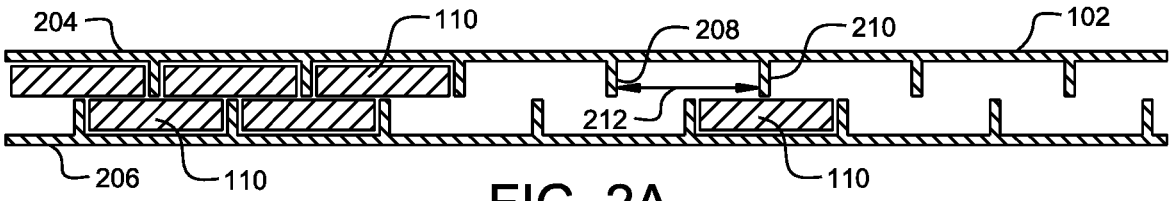
FIGS. 2A and 2B show top and side views (respectively) of a modular privacy fence with a double row of fence pickets.
Figure 2B:
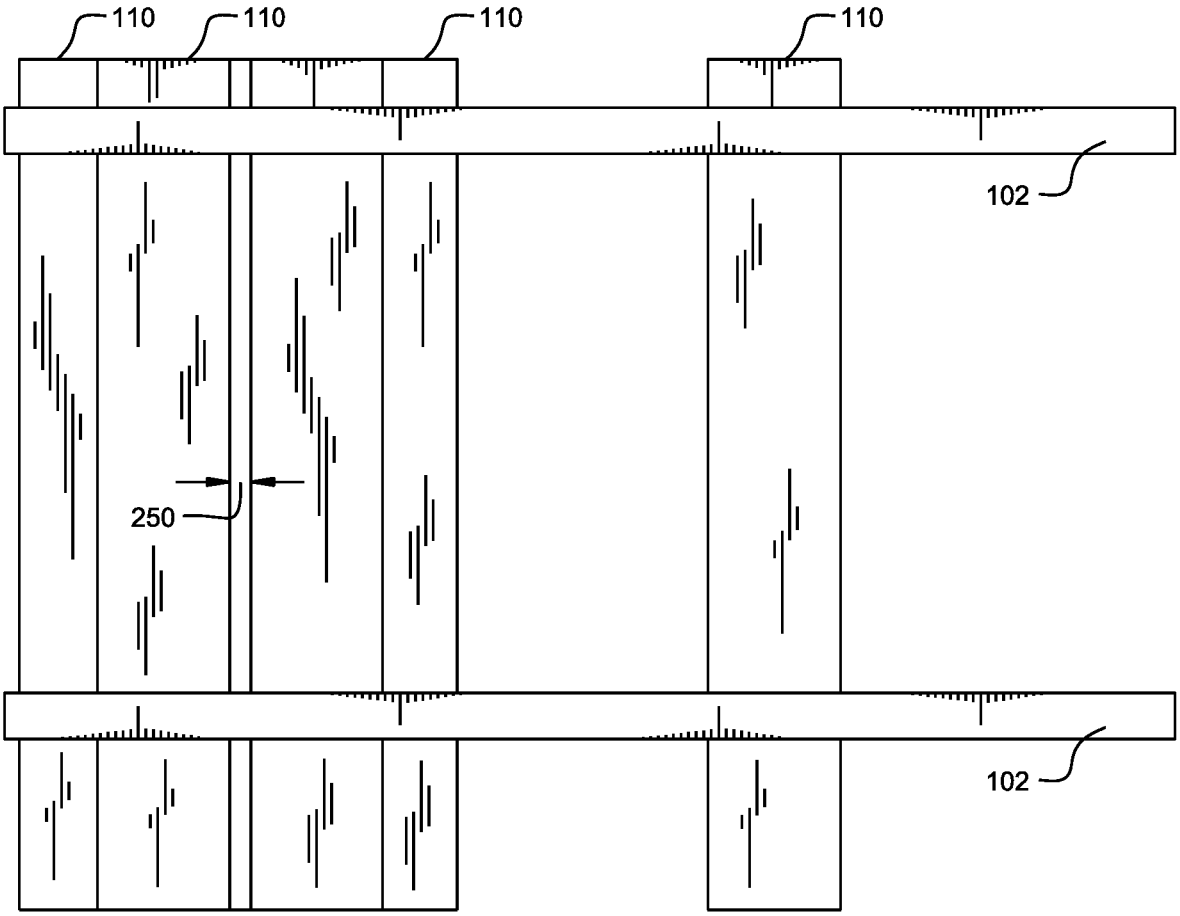

FIGS. 2A and 2B show top and side views (respectively) of a modular privacy fence with a double row of fence pickets. A modular privacy fence 100 may feature different configurations of fence pickets for functional or aesthetic reasons. For example, a double row or fence pickets may provide more privacy and security (less light leakage) than a single row of fence pickets (as illustrated in FIG. 1). Moreover, certain configurations of fence pickets may provide improved sound insulation.

FIG. 2A shows a top view of stringer 102 featuring a double row of pickets according to one embodiment. The stringer 102 has two outer rails (204, 206) that include picket dividers 208 that extend inwardly from the outer rails (204, 206). A fence picket 110 is secured in one direction of motion by two picket dividers (208, 210), which form a picket slot 212. The picket dividers 208 allow pickets 110 to be installed in different patterns. For example, some fence owners who are not concerned with privacy may choose to install only one picket 110 in every other slot (not shown).

The distance between any two picket dividers 208 should be the width of a fence picket 110 plus a small tolerance to allow the picket 110 to be inserted and removed with relative ease. However, the magnitude of the tolerance should be limited (e.g., no more than a few eighths of an inch) to reduce any unintended movement of the fence picket 110 within the picket slot 212 that might occur. A fence picket 110 may also be secured in a second direction of motion (perpendicular to the first) by an opposing picket divider 210. Since pickets 110 come in different dimensions, it is anticipated that different stringers would be manufactured to accommodate common widths/depths (e.g., 3.5" wide and ⅝-1" deep).

FIG. 2B shows a side view of a modular privacy fence 100 featuring two stringers 102 and with pickets 110 arranged according to the stringer pattern depicted in FIG. 2A (above). The width of the picket divider 208 itself may be varied to produce gaps of varying widths in a row of pickets 110.

Figure 3A:
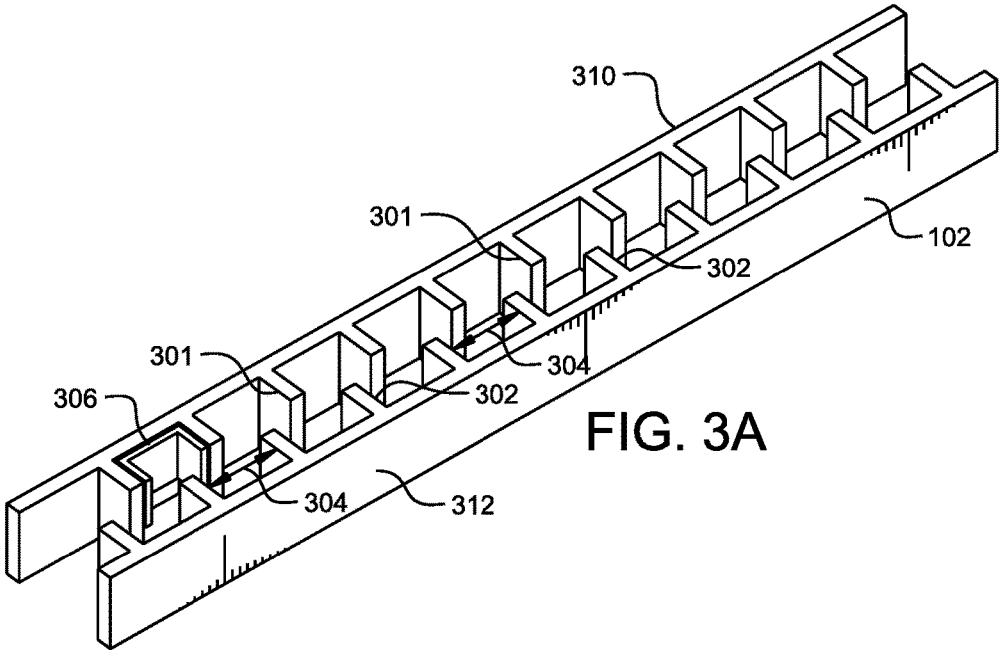
FIGS. 3A and 3B show perspective and top views (respectively) of a double-row stringer according to one embodiment.
Figure 3B:
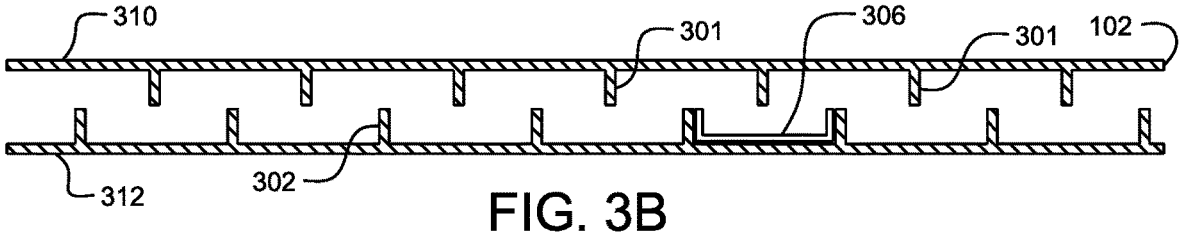

FIGS. 3A and 3B show perspective and top views (respectively) of a double-row stringer according to one embodiment. The double-row stringer 102 comprises outer rails (310, 312), picket dividers (301, 302), and an optional elastomeric insulator 306. In some embodiments, the outer rails (310, 312) may be closed at the ends, or otherwise joined, so as to form a single-bodied stringer 102. In other embodiments, the outer rails (310, 312) may be allowed to move relative to each other so as to permit 'opened' and 'closed' configurations of the stringer 102 (see FIGS. 6A-6E).

The picket dividers (301, 302), which are shown as having the same height as the outer rails (310, 312), may vary in size and shape while still enabling the aforementioned function. The uniformly spaced picket dividers 302 extend inwardly from and perpendicular to the outer rail 310. Opposing picket dividers 301, which form equally sized picket slots 304, are spaced the same distance apart as picket dividers 302 but are offset by a distance. In certain preferred embodiments, picket dividers 301 will be offset such that each picket divider 301 is halfway between two opposing picket dividers 302. The picket dividers (302, 302) will protrude from their corresponding rails 310 by at least ⅛" and, in preferred embodiments, will generally be slightly longer than the depth of a picket 110 (e.g., ⅝"-1") the picket divider is designed to accommodate.

An optional elastomeric insulator 306 may be affixed to the interior surfaces of each of the picket dividers 208. Such elastomeric material 306 reduces excess space that allows lateral picket movement and absorbs any incidental impact from the pickets 110 (i.e., reduces picket jitter from wind) while still permitting pickets 110 to be slidably installed/removed.

In alternative embodiments, the elastomeric insulator 306 may instead by replaced with a tensioning mechanism, such as a bow spring, cantilever spring, or a détente mechanism, positioned on either side of a picket divider (301 or 302), which engages with the sides of an inserted picket 110 so as to provide a closer fit.

For stringers that are made of metal, some may feature any of a variety of finishes (e.g., nickel, gun metal, antique bronze, chrome, satin, etc.). The outer face of the rails (310, 312) may also feature etched ornamental designs (e.g., faux bolt heads, floral patterns, geometric patterns, etc.) to increase the aesthetic appeal. Ornamental designs could be also be configured as separate installable plates that may be affixed to the outer face of a stringer rail via tongue and groove, screws, adhesive, etc.

Figure 4A:
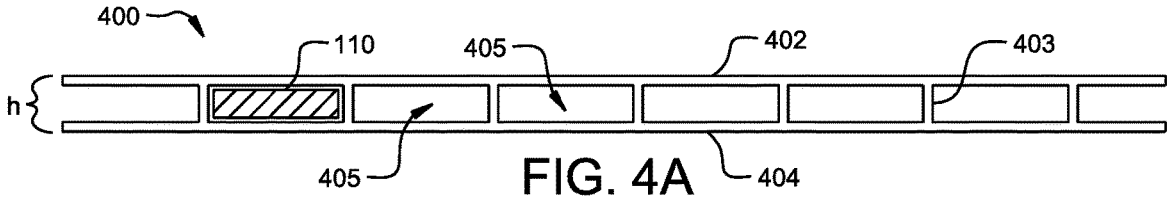
FIG. 4A shows a top view of a single-row stringer according to one embodiment.

FIG. 4A shows a top view of a single-row stringer 400 according to one embodiment. The stringer 400 comprises outer rails (402, 404) and intervening picket dividers 403, which together form an array of slots 405. The height of the slot 405 accommodates a single picket 110. In some embodiments, the picket dividers 403 may be joined to the outer rails (402, 404) by die-cast, welding, extrusion, milling, or any suitable manufacturing method for producing a single body structure. In other embodiments, the stringer 400 may be comprised of an outer rail 402, to which the picket dividers 403 are attached, and a separate second outer rail 404 that may be secured to the first outer rail 402.

Figure 4B:
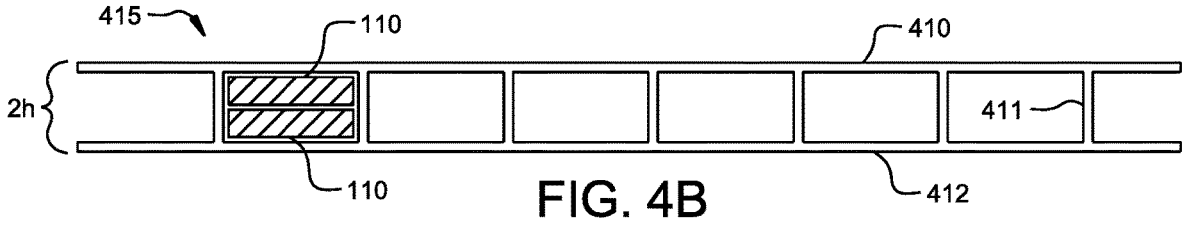
FIG. 4B shows a top view of a double-row stringer according to one embodiment.

FIG. 4B shows a top view of a double-row stringer 415 according to another embodiment. The stringer 415 is arranged in the same manner as stringer 400 except that the width of the resulting structure permits two pickets 110 to pass through the stringer 415 when placed face to face.

Figure 4C:
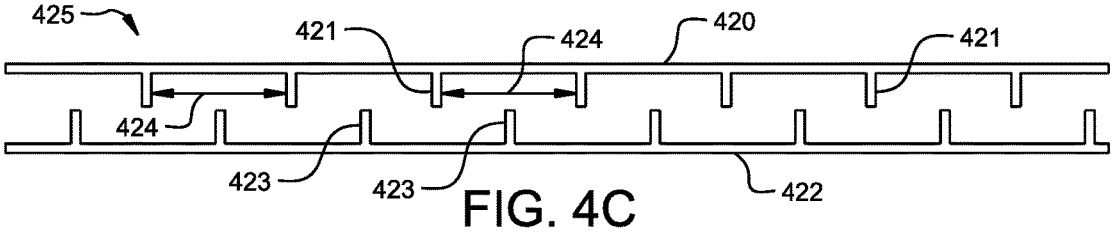
FIG. 4C shows a top view of a double-row stringer according to another embodiment.

FIG. 4C shows a top view of a double-row stringer 425 according to another embodiment. The double-row stringer 425 comprises outer rails (420, 422) and picket dividers (421, 423). In some embodiments, the outer rails (420, 422) may be closed at the ends, or otherwise joined, so as to form a single-bodied stringer. In other embodiments, the outer rails (420, 422) may be allowed to move relative to each other so as to permit 'opened' and 'closed' configurations of the stringer (see FIGS. 6A-6E).

The picket dividers (421, 423), which are shown as having the same height as the outer rails (420, 422), may vary in size and shape while still enabling the aforementioned function. The uniformly spaced picket dividers 423 extend inwardly from and perpendicular to the outer rail 420. Opposing picket dividers 421, which form equally sized picket slots 424, are spaced the same distance apart as picket dividers 423 but are offset by a distance. In certain preferred embodiments, picket dividers 421 will be offset such that each picket divider 301 is halfway between two opposing picket dividers 423.

Figure 4D:
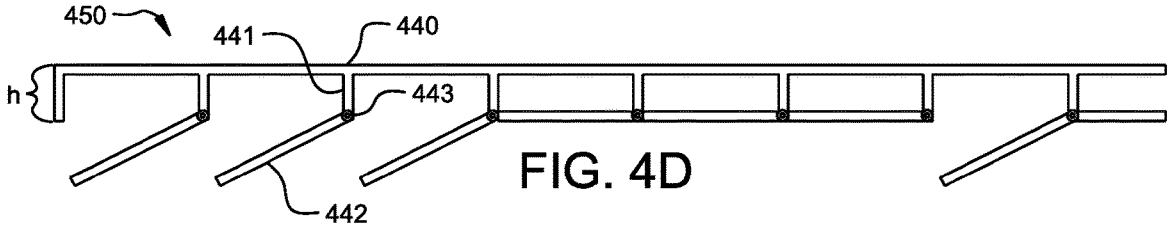
FIGS. 4D and 4E show top and perspective views (respectively) of a gated, single-row stringer according to yet another embodiment.
Figure 4E:
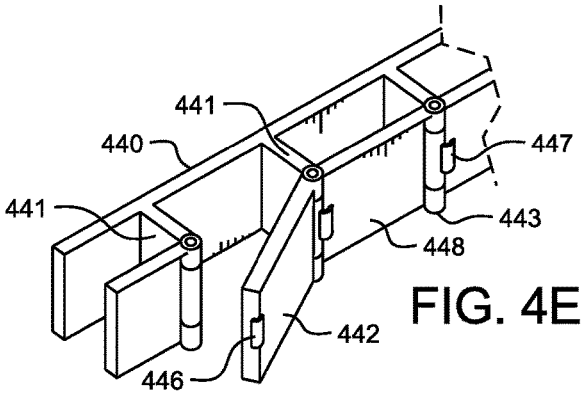

FIGS. 4D and 4E show top and perspective views (respectively) of a gated, single-row stringer 450 according to yet another embodiment. The stringer 450 comprises an outer rail 440, picket dividers 441, and picket gates 442. A picket gate 442 is attached to a corresponding picket divider 441 via a hinge 445, which enables the picket gate 442 to swing open and shut so as to retain a fence picket 110. In some embodiments, the picket gate 442 may be kept in a closed position using a clasp 446. In order to permit a neighboring picket gate 448 (shown closed) to be opened without disturbing the picket gate 442, each picket gate may include an opening 447 near the hinge 445, which is slightly larger than the protruding portion of the clasp 446 so as to permit the clasp 446 to pass through the opening 447.

Figure 5A:
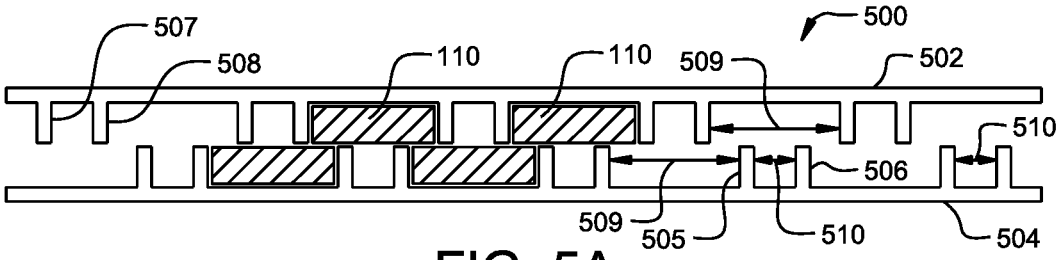
FIGS. 5A, 5B, and 5C show top views of various embodiments of a double-row stringer with picket spacers.
Figure 5B:
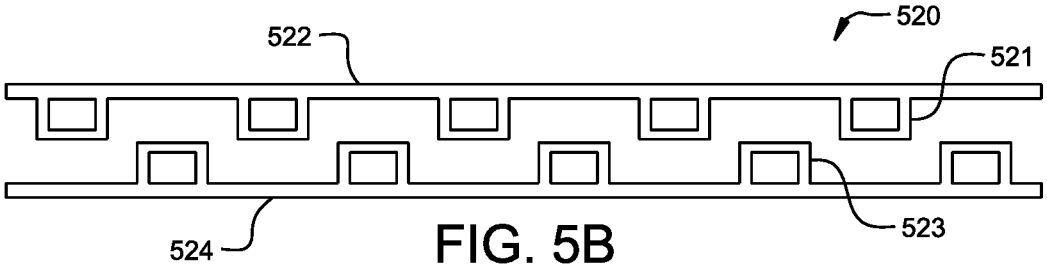
Figure 5C:
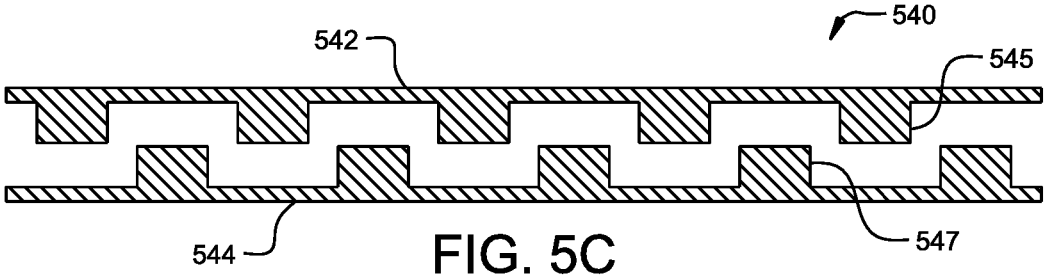

FIGS. 5A, 5B, and 5C show top views of various embodiments of a double-row stringer with picket spacers. FIG. 5A illustrates a stringer 500 that includes outer rails (502, 504), each with left and right picket dividers (505, 506) that form alternating picket slots 509 and picket spacers 510. The spacing and arrangement of the picket dividers (505, 506) depend on the width of the picket 110 that the stringer is designed to accommodate (e.g., see Table 1 above) and the desired spacing between any given picket in a particular row. In preferred embodiments, the width of the picket spacers 510 will be at least ⅛ of an inch wide and no greater than the width of the corresponding picket slots 509 in order to ensure adequate privacy (i.e., no visible gaps in the fence). However, the spacing between pickets may be increased in order to save cost (i.e., the larger the space the less fence pickets that are required to cover a particular fence length) or to achieve a certain design aesthetic.

FIG. 5B shows a top view of a double-row stringer 520 with closed, U-shaped picket spacers (512, 523) according to another embodiment. A U-shaped picket spacer 521 may be cast, formed, milled, welded, or otherwise manufactured or machined to form a three-sided protrusion with substantially flat sides. In preferred embodiments, the height of the U-shaped picket spacers (521, 523) will be at least ⅛ of an inch and will generally not exceed the height of the corresponding outer rail (522, 524). Where material costs are an issue, a U-shaped picket will be less costly than the solid picket spacer depicted in FIG. 5C.

FIG. 5C shows a top view of a double-row stringer 540 with solid picket spacers (545, 547). The solid picket spacers may be made of a single material (e.g., metal) or the spacers (545, 547) may be filled using a fill such as, plastic, resin, composite, rubber, etc. Certain fills with a higher degree of elasticity may reduce the overall resonance of the stringer. Solid picket spacers have the added advantage of having increased yield and impact strength.

Figure 5D:
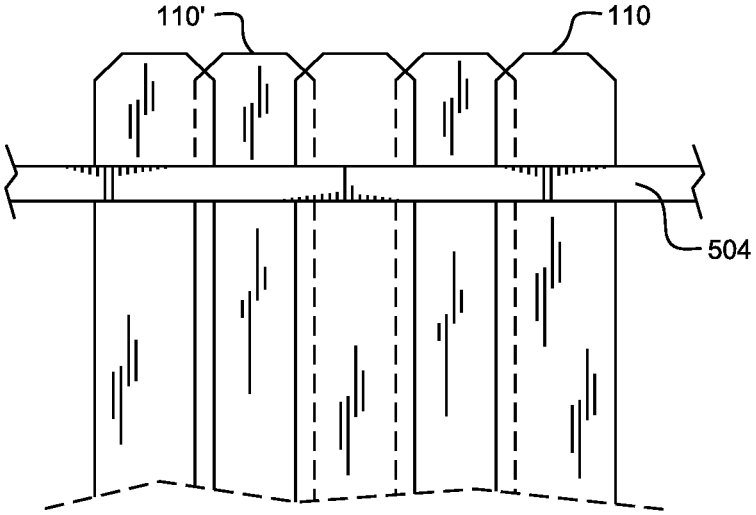
FIG. 5D shows a side view of a modular privacy fence with fence pickets installed using a double-row stringer with picket spacers.
Figure 6A:
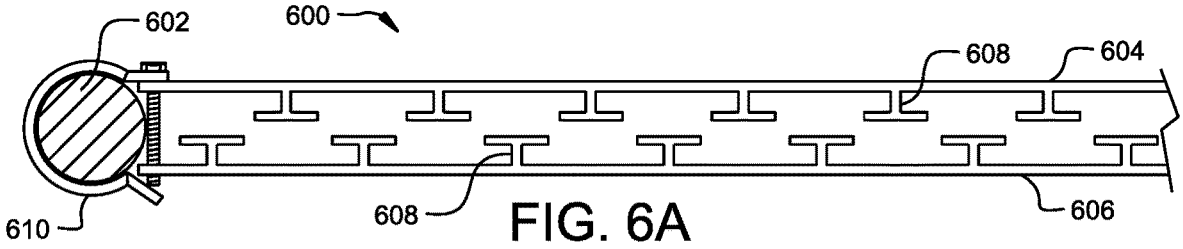
FIGS. 6A-6E show top and perspective views of a clamping stringer attached to a fence post in 'opened' and 'closed' configurations.
Figure 6B:
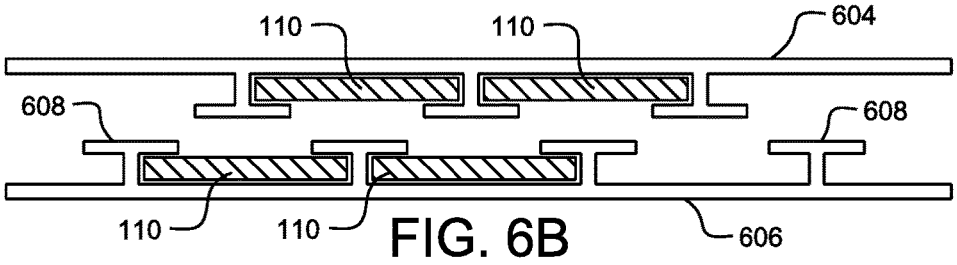
Figure 6C:
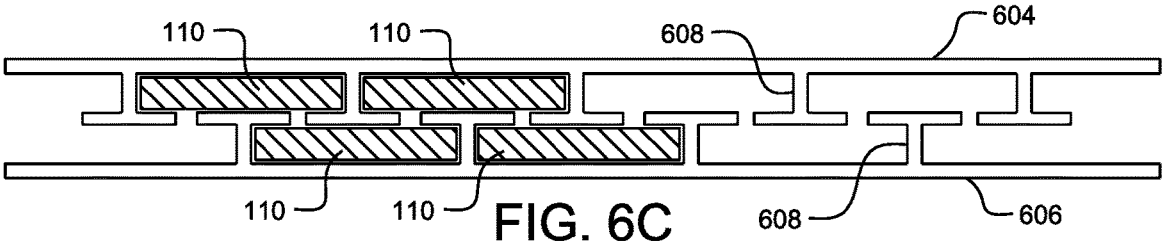
Figure 6D:
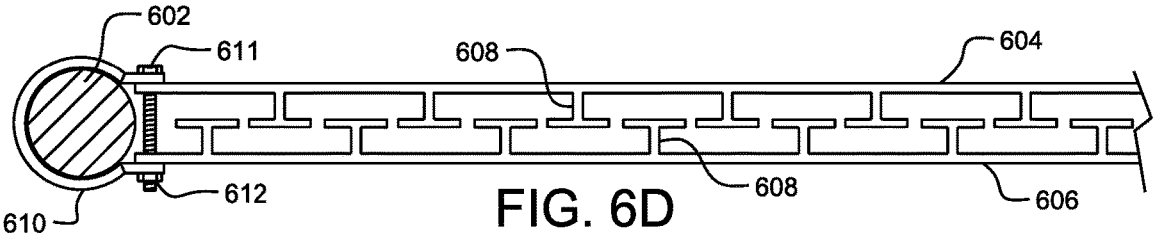
Figure 6E:
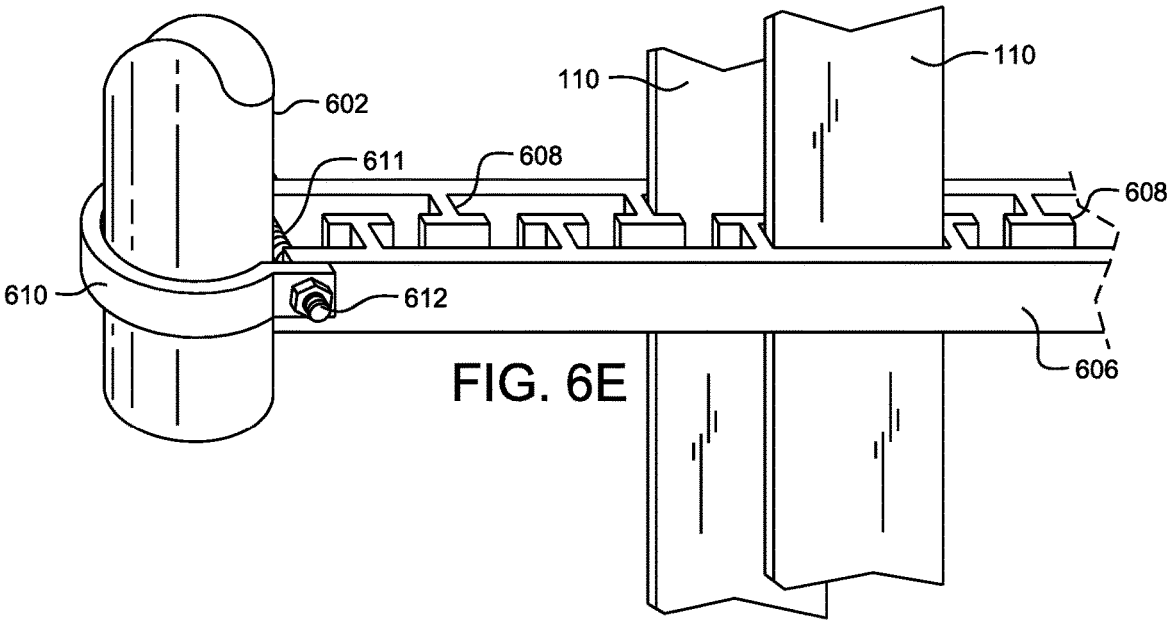

FIG. 5D shows a side view of a modular privacy fence with fence pickets installed using a double-row stringer with picket spacers. As can be immediately envisioned from the figure, the size of the picket spacers impacts the visibility of the second row of fence pickets 110'.

Of course, picket spacers are not limited to use with double-row stringers. In alternative embodiments, a single row stringer may include picket spacers in order to achieve the look of a conventional picket fence, albeit with the consequence of decreased privacy.

FIGS. 6A-6E show top and perspective views of a clamping stringer 600 attached to a fence post in 'opened' and 'closed' configurations. In such an embodiment, the two sides of a stringer may be opened or closed like a clamp in order to install/remove fence pickets. When in an opened configuration (see, e.g., FIGS. 6A and 6B), fence pickets 110 can be slidably inserted between the picket dividers from above. When the stringer is in a closed configuration (i.e., the stringer bars are moved closer together as in FIGS. 6C and 6D), a T-like post from the opposing stringer places pressure on its corresponding picket 110, thus securing it in place. In effect, the two stringer bars provide a jaw-like mechanism that clamps down on any fence pickets that have been inserted into the stringer arrangement. In some embodiments, the inside surface of the stringers and/or the ends of the picket dividers 608 may be given an abrasive finish (e.g., small ridges, points, or a special grit coating) to improve the grip on a fence picket. As an alternative to the T-like picket dividers 608 depicted in FIGS. 6A-6D, other double-row stringer designs, such as those depicted in FIGS. 5A-5C, may also be substituted while achieving the same effect.

The stringers (604, 606) are connected to each other using a fastener which provides the necessary compressive force. For example, the fastener might include a circumferential bracket 610 that is fitted with a bolt 611 that pierces the rails (604, 606) of the stringer and is secured in place with a nut 612. The nut 612 could be tightened to increase the compressive force on the fence pickets 110. Alternatively, a fastener might include a clamp, a pull-action latch clamp, a tie (e.g., rope), or any suitable means for impermanently compressing/decompressing the stringer arrangement. Longer stringer sections might require additional compressive fasteners positioned through the length of the stringer so as to apply an even force throughout.

Figure 7A:
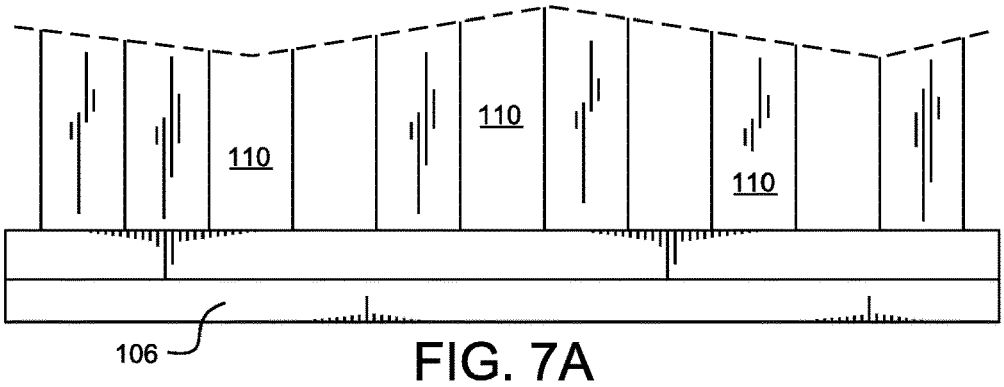
FIGS. 7A, 7B, 7C, and 7D show side, cross-sectional, perspective, and top views (respectively) of a bottom rail.
Figure 7B:
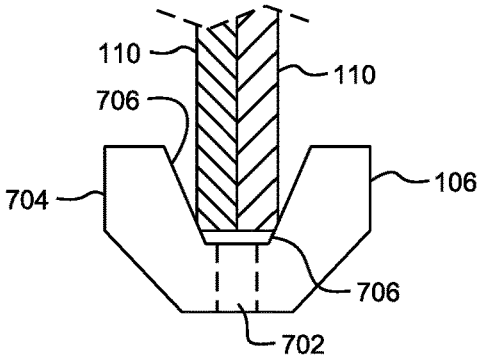
Figure 7C:
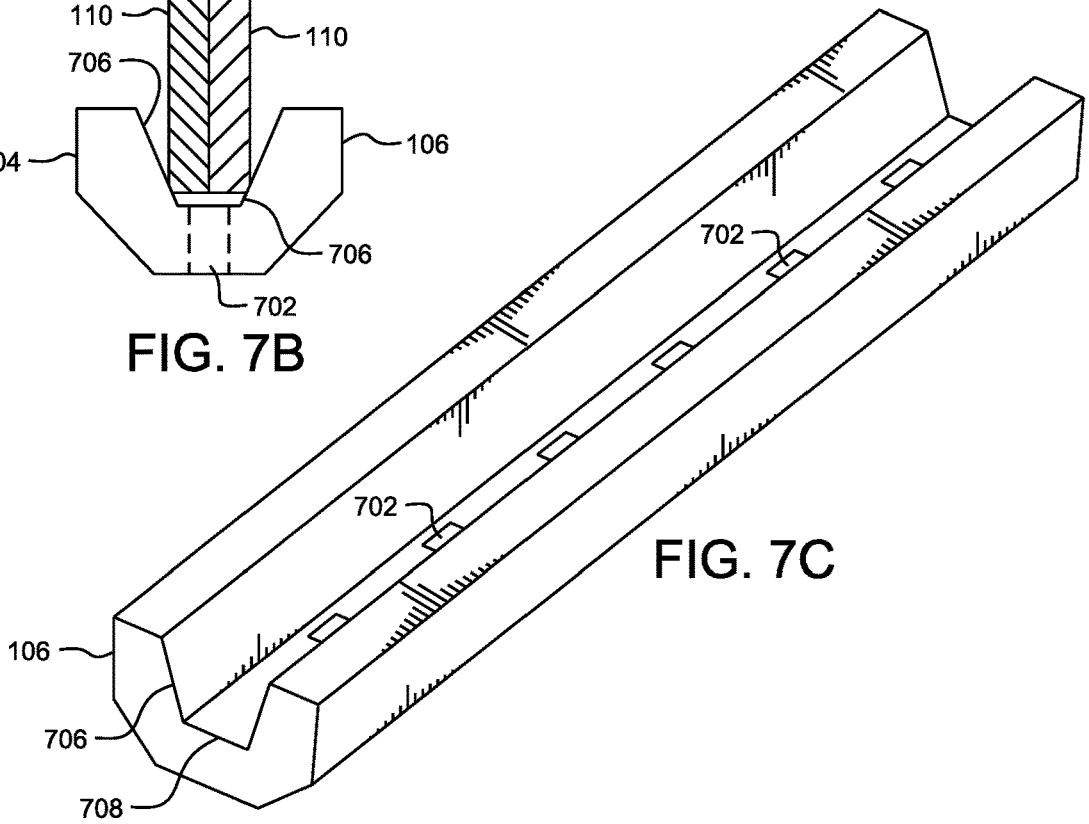
Figure 7D:
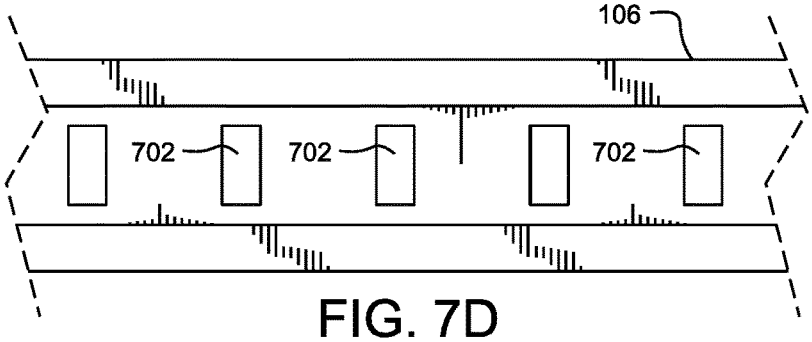

FIGS. 7A, 7B, 7C, and 7D show side, cross-sectional, perspective, and top views (respectively) of a bottom rail. As previously described, a bottom rail 106 is a special type of stringer that prevents a fence picket 110 from falling through the fence 100. A bottom rail may be constructed from wood, metal, composite, or any suitably rigid material. The bottom rail 106 comprises a trough 708 with sides 706 that runs the length of the fence section such that a bottom rail 106 will be substantially the same length as a corresponding stringer 102. In some embodiments (pictured), the sides of the trough 706 may be angled so as to apply a net force along the decline to the picket ends of a double-row fence when pressure is applied to the pickets 110 from above. This has the effect of ensuring a tight fit between facing pickets 110 in the bottom rail 106. As shown in FIGS. 7C and 7D, the bottom rail 106 may also feature drain holes 702 which permit fluids that accumulate in the trough, such as rain water, to drain.

Figure 8A:
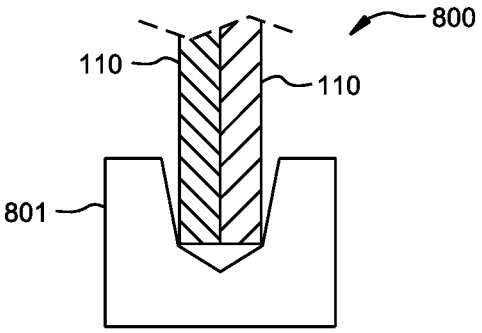
FIGS. 8A-8D show a cross-sectional views of various embodiments of a bottom rail.
Figure 8B:
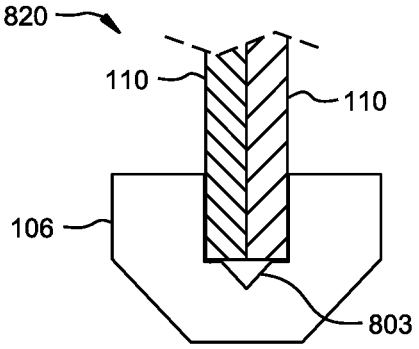
Figure 8C:
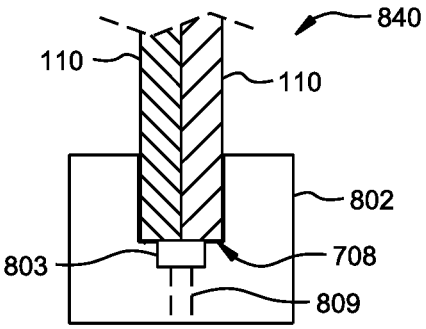
Figure 8D:
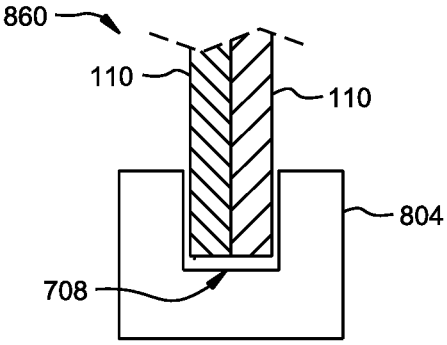

FIGS. 8A-8D illustrate cross-sectional views of various embodiments of a bottom rail 106. As shown, the outer contour of the bottom rail 106 is rectangular or trapezoidal; however, other embodiments may feature curved surfaces or more complex shapes as might be found in crown molding for example. Some bottom rails, such as those depicted in 8B and 8C, may feature a channel 803 in the bottom of the trough 708 that draws water away from the bottom of the fence pickets 110, which may deteriorate or warp if water is drawn into the picket through capillary action. Such a channel may have a slight decline (from the midpoint of the bottom rail) to allow gravity to cause the excess water to run off. As shown in FIG. 8C, the channel may have various shapes to its cross section and may work in conjunction with drain holes 809.

Figure 9:
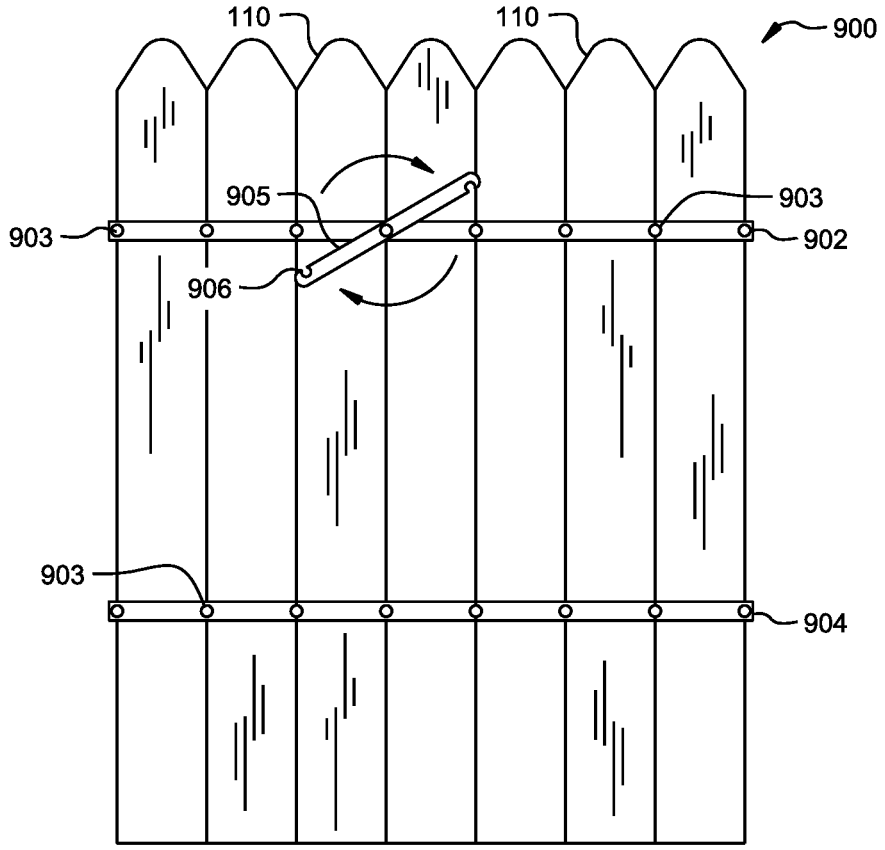
FIG. 9 shows a side view of a modular privacy fence with a gated, single-row stringer according to one embodiment.
Figure 10:
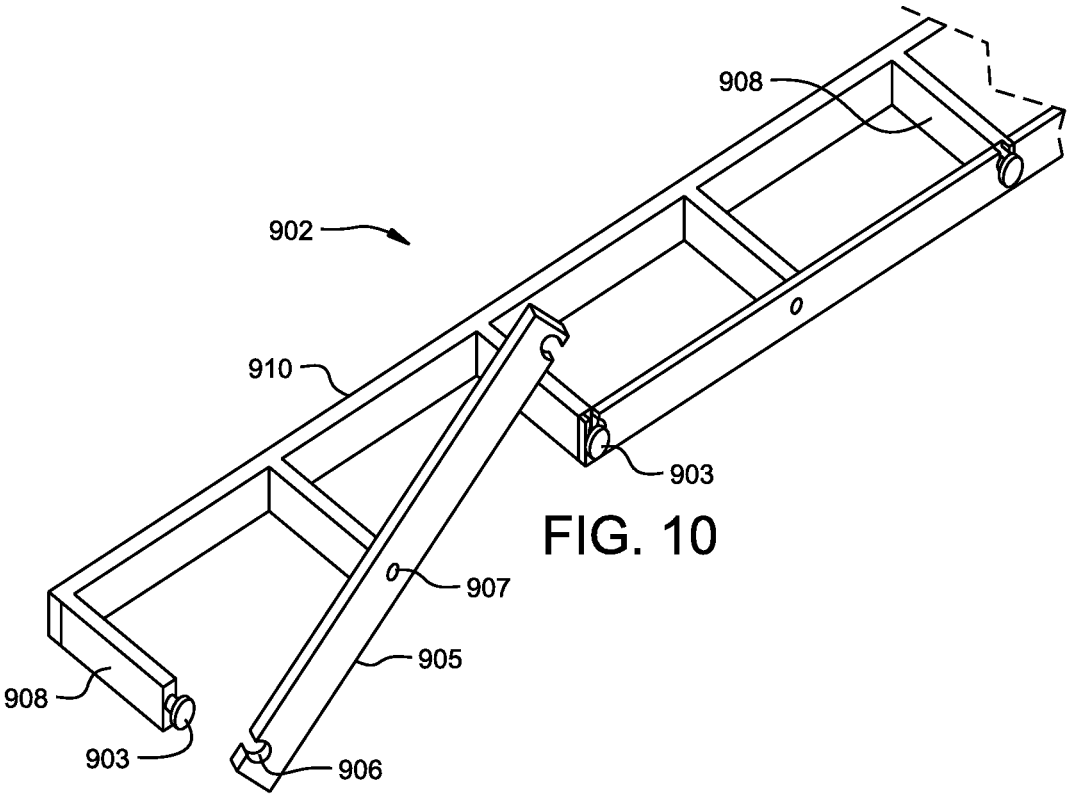
FIG. 10 shows a perspective view of a modular privacy fence with a gated, single-row stringer according to one embodiment.

FIG. 9 shows a side view of a modular privacy fence 900 with a gated, single-row stringer 902 according to one embodiment. FIG. 10 shows the stringer 902 in perspective. The gated stringer 902 includes an outer rail 910 and a plurality of picket dividers 908 with rotatable gates 905. The gate 905 rotates about an axle 907, which extends from a picket divider 908, and locks into place using a hook or catch 906 that mates with posts 903. The gate 905 includes a catch or hook 906 on each end of the gate that are oriented in opposite directions. Each post 903 must accommodate two overlapping catches or hooks 906. One of the ends of each gate might be slightly raised (not pictured) so as to allow it to overlap a neighboring catch when in a locked position. As illustrated in FIG. 9, a fence picket 110 may be installed or removed by rotating the corresponding gate 905 open 90 degrees to its locked position (for each stringer).

FIGS. 11-16 depict embodiments in which the stringer comprises a single longitudinally extending upper rail rather than two parallel rails. Embodiments with a single upper rail save materials and costs when compared with stringers with two rails. Moreover, the single upper rail embodiment retains ease of replacing and repairing fence pickets and also addresses privacy considerations.

Figure 11:
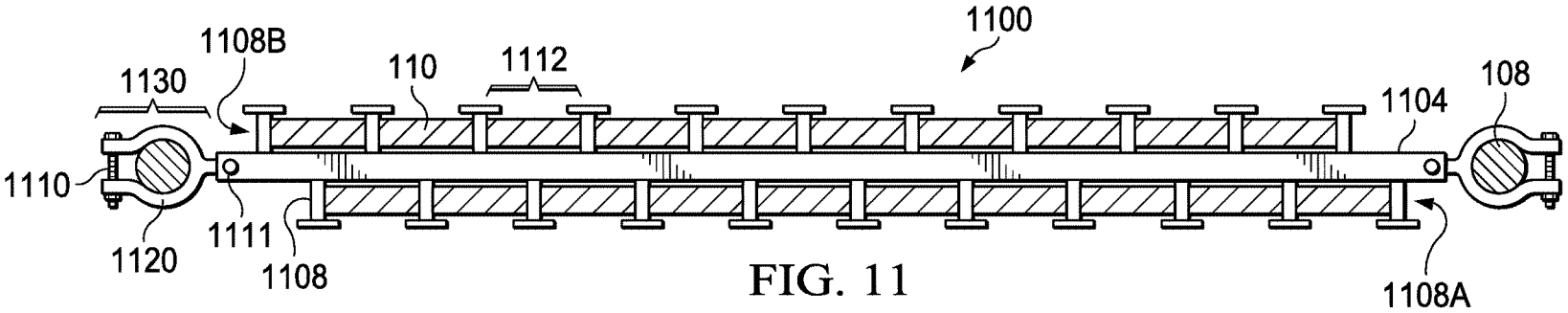
FIG. 11 shows a top view of a modular privacy fence with a double row of fence pickets arranged on opposing sides of an upper rail according to one embodiment.
Figure 12:
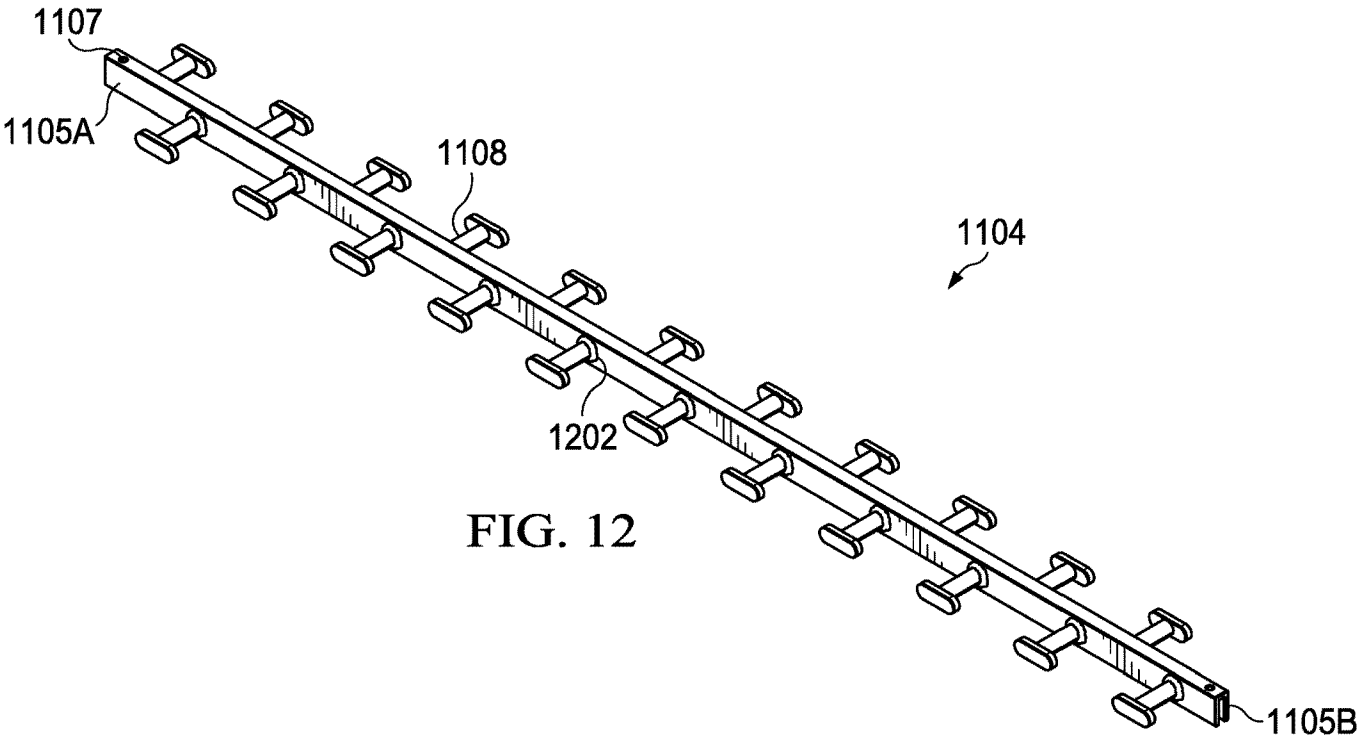
FIG. 12 shows a perspective view of a modular privacy fence with a double row of fence pickets arranged on opposing sides of an upper rail according to one embodiment.

FIG. 11 shows a top view of a modular privacy fence 1100 with a double row of fence pickets 110 arranged on opposing sides of an upper rail 1104 according to one embodiment. FIG. 12 shows an upper rail 1104 in perspective. The upper rail 1104 includes a plurality of laterally extending fence picket dividers 1108 on opposed outer side surfaces 1105 of the upper rail 1104. The dividers 1108 can have a T-shaped cross-section extending in the perpendicular direction from the opposed outside surfaces of the upper rail 1104 such that the top portion of the T-shaped cross-section is parallel to the upper rail and is configured to hold the fence picket in place. In some embodiments the bottom portion 1202 of the T-shaped divider is welded onto the opposed outer surfaces of the upper rail. By using a single upper rail 1104 rather than two, cost of manufacturing can be reduced significantly.

In some embodiments, the picket fence dividers 1108 on one side of the upper rail 1104 are offset from the fence picket dividers 1108 on the opposing side of the upper rail 1104 in direction parallel to the upper rail. By way of example, none of the dividers 1108 in a first set of fence picket dividers 1108A on a first side of the upper rail 1105A are aligned along the upper rail 1104 with any of the dividers 1108 in a second set of fence picket dividers 1108B on a second side of the upper rail 1105B. The dividers 1108 are disposed such that slots 1112 are formed between adjacent dividers 1108 on each side of the upper rail 1104. The slots 1112 are configured to receive fence pickets 110. By staggering the fence picket dividers 1108, when the modular privacy fence 1100 is fully assembled with fence pickets 110, no gaps between the pickets 110 are visible when viewing the fence at various angles. In some embodiments, the dividers 1108 are spaced evenly throughout the length of each side of the upper rail 1104 to create slots 1112 of equal size. For example, each of the slots 1112 can be substantially the same width of a fence picket 110 such that each slot 1112 is configured to receive a fence picket 110.

Figure 13:
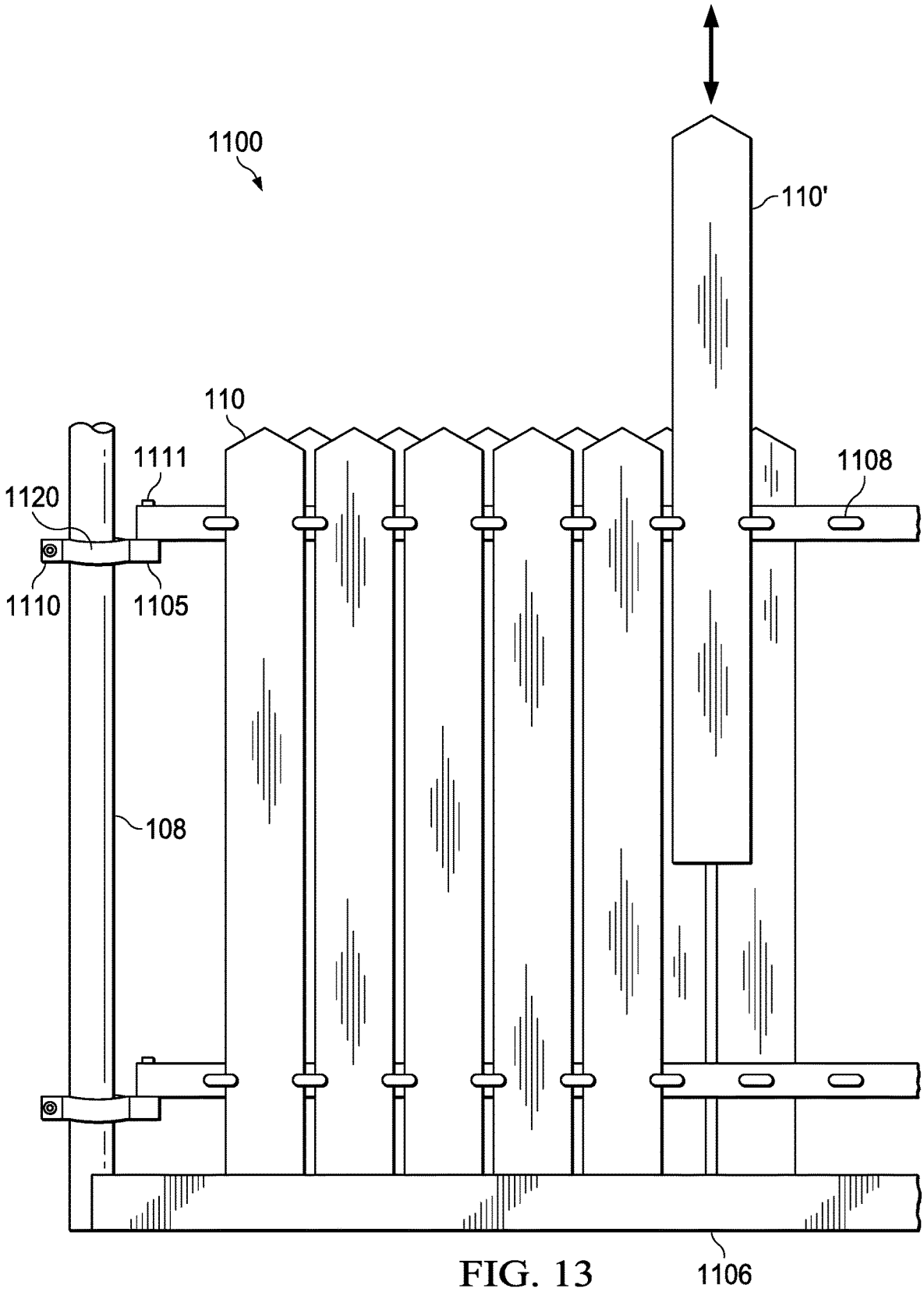
FIG. 13 shows a side view of a modular privacy fence with a double row of fence pickets arranged on opposing sides of an upper rail according to one embodiment.

FIG. 13 shows a side view of a modular privacy fence 1100 with a double row of fence pickets 110 arranged on opposing sides of an upper rail 1104 according to an exemplary embodiment. As can be seen from FIG. 13, if fence pickets 110 are arranged in each slot 1112 on each of the first and second sides of the upper rail 1104, then no gaps can be seen between the fence pickets 110 when viewing the modular privacy fence 1100 from any angle.

In some embodiments, the modular privacy fence 1100 also comprises a bottom rail having a trough. The trough is capable of receiving the bottom portion of fence pickets. In some embodiments, the modular privacy fence can comprise more than one upper rail. For example, the modular privacy fence 1100 can have a longitudinally extended center rail similar to the upper rail such that the center rail is disposed between the upper rail 1104 and the bottom rail 1106 along the length of the fence posts 108.

Figure 14:
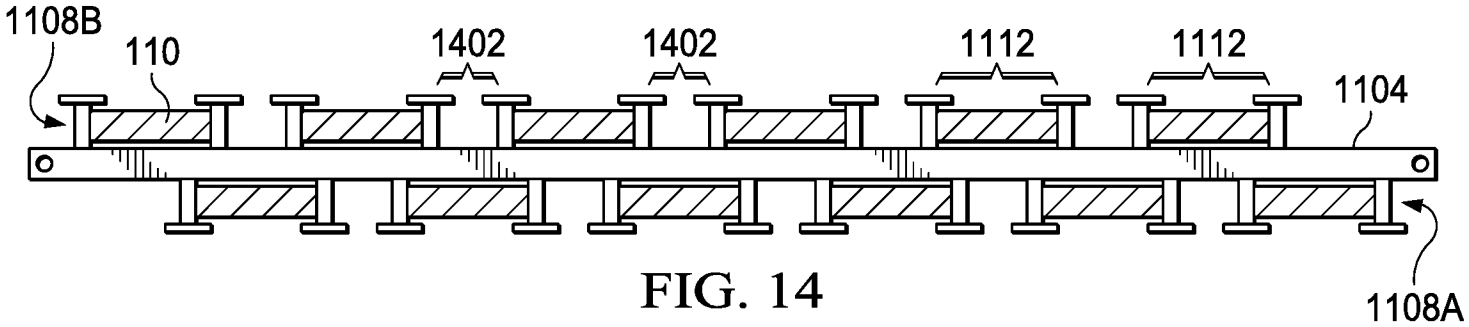
FIG. 14 shows a top view of a modular privacy fence with a double row of fence pickets arranged on opposing sides of an upper rail with spaces between adjacent pickets according to one embodiment.
Figure 15:
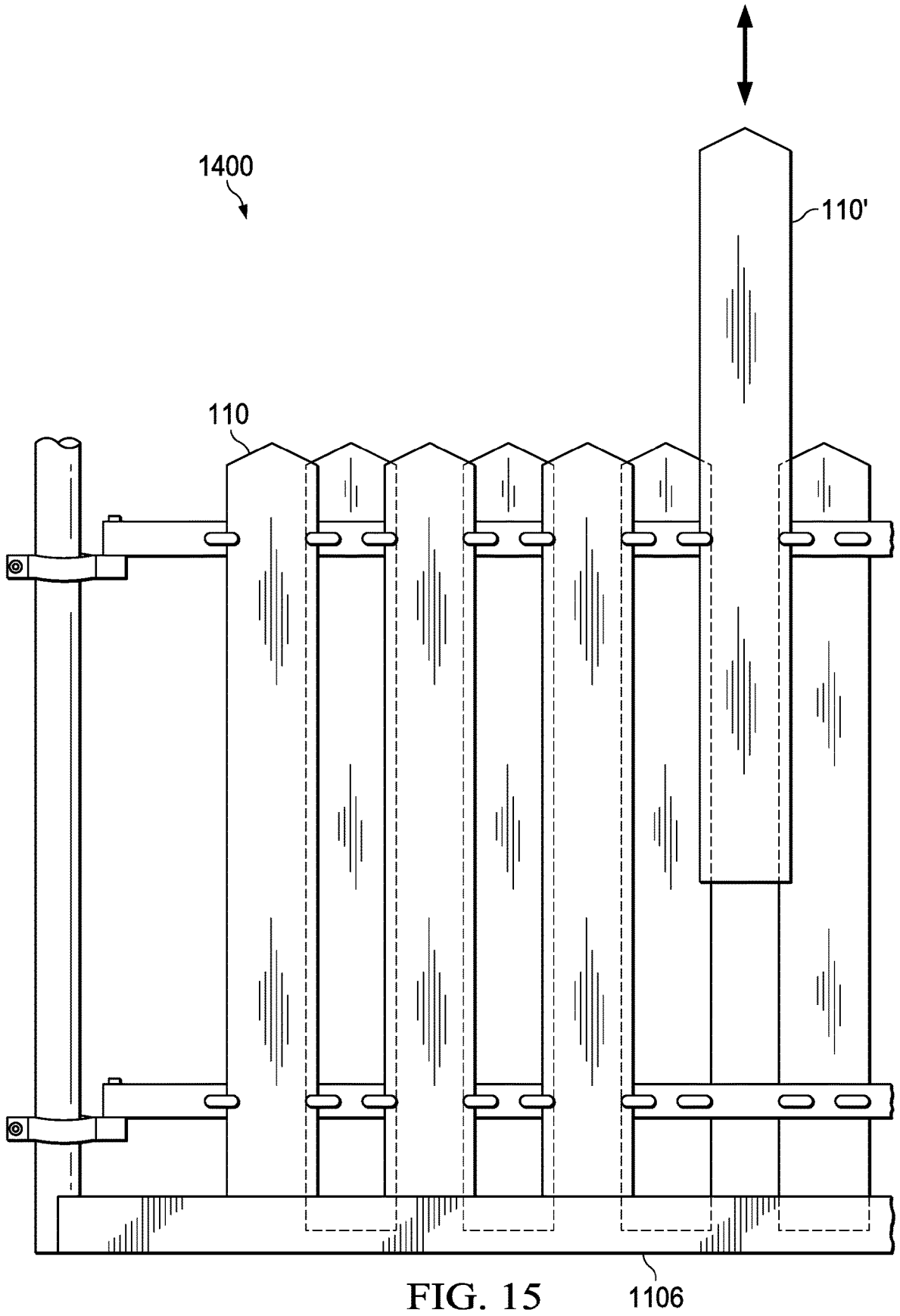
FIG. 15 shows a side view of a modular privacy fence with a double row of fence pickets arranged on opposing sides of an upper rail with spaces between adjacent pickets according to one embodiment.

FIG. 14 shows a top view of a modular privacy fence 1400 with a double row of fence pickets arranged on opposing sides of an upper rail with spaces 1402 between adjacent pickets 110 according to one embodiment. For example, a first and second picket divider 1108, adjacent to one another, can be spaced apart from one another by substantially the same width as a fence picket width such that the fence picket can be placed in the slot 1112 between the two dividers 1108. Additionally, the second picket divider can be spaced apart from a third picket divider by a space 1402 with a width less than the width of a fence picket 110. Thus, in some embodiments, pickets 110 can be placed in the slots 1112 between every other pair of adjacent picket dividers 110 on a first side 1105A of the upper rail 1104. Similarly, pickets 110 can be placed in the slots 1112 between every other pair of adjacent pickets 110 on the second side 1105B of the upper rail 1104 such that the spaces 1402 are offset from one another from the first side to the second side of the upper rail 1104 in a direction parallel to the upper rail. As can be seen from FIG. 15, if fence pickets 110 are arranged in this manner, then no gaps can be seen between the fence pickets 110 when viewing the modular privacy fence 1400 from any angle.

Each end of the upper rail 1104 can be secured to fence posts using fasteners 1130. For example, the fastener 1130 might include a circumferential bracket 1120 that is fitted with a bolt 1110 that is secured in place with a nut. The circumferential bracket 1120 can be secured to the fence post 108 prior to installing the upper rail 1104. Once the fastener 1130 is positioned on the fence post 1130, the upper rail 1104 can drop onto an upward facing protrusion 1111 of the fastener 1130 such that an aperture 1107 at the top of the upper rail 1104 is slidably engaged with the protrusion 1111 of the fastener 1130.

Figure 16A:
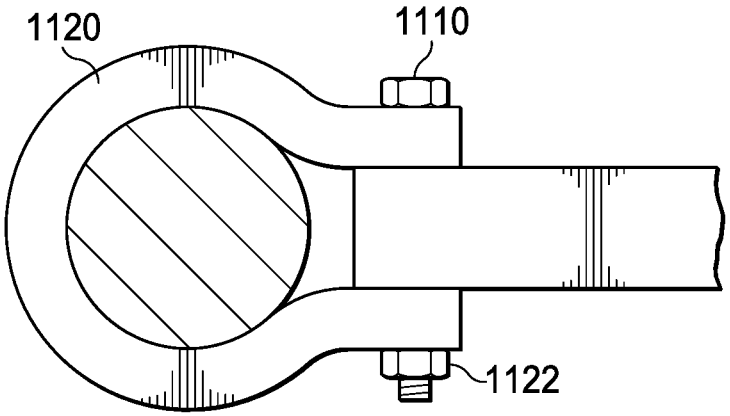
FIG. 16A shows a top view of an upper rail with a C-clamp fastener according to one embodiment.
Figure 16B:
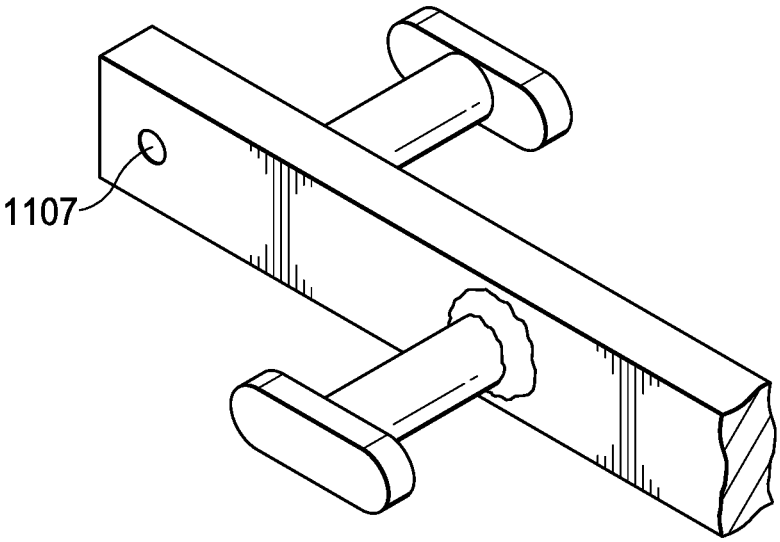
FIG. 16B shows a side view of an upper rail with side apertures according to one embodiment.

Alternatively, as shown in FIGS. 16A and 16B, a fastener might include a c-clamp which secures around the fence post 108 and engages the upper rail 1104 via a side aperture 1107 configured to receive the bolt 1110 which is then secured with a nut 1122.

I claim:

1. A modular privacy fence, comprising:

a longitudinally extending upper rail;

a plurality of laterally extending picket dividers on opposed outer side surfaces of the upper rail, wherein the picket dividers are spaced along the upper rail, wherein further the upper rail is configured to receive fence pickets in slots between the picket dividers on each outer side of the upper rail;

a first fastener configured to secure a first end of the upper rail to a first post;

a second fastener configured to secure a second end of the upper rail to a second post; and a bottom rail having a trough, the trough comprising a first sidewall, a second sidewall and a bottom wall interconnected between the first sidewall and the second sidewall, wherein the trough is configured to receive a bottom portion of the fence pickets.

2. The modular privacy fence of claim 1, wherein the picket dividers comprises a T-shaped cross-section extending in a perpendicular direction from the opposed outer side surfaces of the upper rail, wherein further a top portion of the T-shaped cross-section is parallel to the upper rail and is configured to hold the fence picket in place.

3. The modular privacy fence of claim 1, wherein a plurality of pickets are disposed along the upper rail alternating between each opposed outer sides of the upper rail.

4. The modular privacy fence of claim 3, comprising;

a first picket divider adjacent to a second picket divider, wherein the first picket divider is spaced apart from a second picket divider by substantially the same width as a fence picket width such that a fence picket can be placed between the first picket divider and the second picket divider; and a third picket divider spaced apart from the second picket divider by less than the picket width, wherein the third picket divider is disposed adjacent to the second picket divider.

5. The modular privacy fence of claim 1, wherein the first fastener comprises:

a first circumferential bracket coupled to the first fence post;

an upward extending protrusion of the first circumferential bracket;

a receiving portion of the first end of the upper rail, wherein the protrusion is capable of securing onto the receiving portion coupled to the first end of the upper rail.

6. The modular privacy fence of claim 5, wherein the receiving portion of the first end of the upper rail is an aperture on the top portion of the upper rail.

7. The modular privacy fence of claim 1, comprising:

a longitudinally extending center rail; and a plurality of laterally extending picket dividers on opposed outer side surfaces of the center rail, wherein the picket dividers are spaced along the center rail from a first end of the center rail to a second end of the center rail, wherein further the center rail is configured to receive fence pickets in slots between each of the picket dividers on each outer side of the center rail, wherein further the upper rail is disposed in an upper portion along the fence post, the center rail disposed in a central portion along the fence post, and the bottom rail is disposed in a bottom portion along the fence post.

8. The modular privacy fence of claim 1, wherein the plurality of laterally extending picket dividers on a first outer side of the upper rail is offset from the plurality of laterally extending picket dividers on a second outer side of the upper rail.

9. The modular privacy fence of claim 1, wherein the picket dividers are spaced along the upper rail from a first end of the upper rail to a second end of the upper rail.

10. The modular privacy fence of claim 1, wherein a plurality of fence pickets are disposed along the upper rail between adjacent fence picket dividers.

11. The modular privacy fence of claim 10, wherein a pair of adjacent fence picket dividers of the plurality of fence picket dividers is spaced apart by substantially the same width as a fence picket.

12. The modular privacy fence of claim 10, wherein the picket dividers comprises a T-shaped cross-section extending in a perpendicular direction from the opposed outer side surfaces of the upper rail, wherein further a top of the portion of the T-shaped cross-section is parallel to the upper rail and is configured to hold the fence picket in place.

13. The modular privacy fence of claim 10, wherein the fence picket dividers are welded onto the opposed outer surfaces of the upper rail.

14. The modular privacy fence of claim 10, wherein the first and second fasteners are C-clamps.

15. The modular privacy fence of claim 10, wherein the plurality of laterally extending picket dividers on a first outer side of the upper rail is offset from the plurality of laterally extending picket dividers on a second outer side of the upper rail.

16. A modular privacy fence, comprising:

a first post;

a second post separated from the first post;

a longitudinally extending upper rail attached to the first post and the second post, wherein the upper rail comprises a plurality of slots arranged in two rows on opposing sides of the upper rail;

a bottom rail attached to the first post and the second post, wherein the bottom rail comprises a trough, the trough comprising a first sidewall, a second sidewall and a bottom wall interconnected between the first sidewall and the second sidewall, wherein the trough is configured to receive a bottom portion of fence pickets;

a first row of slots in the plurality of slots configured to receive vertical fence pickets, wherein when installed, the fence pickets intersect the upper rail, wherein further the first row of slots is disposed on a first side of the upper rail; and a second row of slots in the plurality of slots configured to receive vertical fence pickets, wherein when installed, the fence pickets intersect the upper rail, wherein further the second row of slots is disposed on a second side of the upper rail.

17. The modular privacy fence of claim 16, wherein the first row of slots is staggered from the second row of slots along the upper rail.

18. The modular privacy fence of claim 16, comprising:

a first slot along the first row of slots configured to receive a first fence picket, a second slot adjacent to the first slot comprising a width less than a width of a fence picket, wherein the second slot is configured to provide a space between the first fence picket and a second fence picket; and a third slot adjacent to the second slot configured to receive the second fence picket.

19. The modular privacy fence of claim 16, wherein each slot along the first row of slots and the second row of slots is substantially the same width as a fence picket.

20. The modular privacy fence of claim 16, wherein each slot in the first row of slots is formed between adjacent dividers laterally extending from a first outer side surface of the first side of the upper rail, wherein further each slot in the second row of slots is formed between adjacent dividers laterally extending from a second outer side surface of the upper rail.

* * * * *